United States Patent [19]

Tuovinen et al.

[11] Patent Number: 4,740,239

[45] Date of Patent: Apr. 26, 1988

[54] PROCESS FOR EXPLOITATION OF LOW GRADE OXIDIC AND IRON-BEARING COMPLEX ORES OR CONCENTRATES

[75] Inventors: Frans H. Tuovinen, Ulvila; Seppo O. Heimala; Stig-Erik Hultholm, both of Pori; Risto J. Honkala, Vanha-Ulvila; Helge J. Krogerus, Pori; Matti E. Honkaniemi, Tornio, all of Finland

[73] Assignee: Outokumpu Oy, Helsinki, Finland

[21] Appl. No.: 843,069

[22] Filed: May 27, 1986

Related U.S. Application Data

[63] Continuation of Ser. No. 679,262, Dec. 7, 1984, abandoned, which is a continuation of Ser. No. 339,807, Jan. 15, 1982, abandoned.

[30] Foreign Application Priority Data

Jan. 23, 1981 [FI] Finland ..... 810185

[51] Int. Cl.[4] ..... C22B 23/00; C22B 34/22; C21B 11/06

[52] U.S. Cl. ..... 75/21; 75/40; 75/82; 75/84

[58] Field of Search ..... 75/10.60, 10.61, 10.63, 75/21, 24, 31, 80, 82, 84, 40

[56] References Cited

U.S. PATENT DOCUMENTS

| | | | |
|---|---|---|---|
| 2,026,683 | 1/1936 | Johannsen | 75/31 |
| 2,805,930 | 9/1957 | Udy | 75/10.61 |
| 2,986,459 | 5/1961 | Udy | 75/10.61 |

*Primary Examiner*—Melvyn J. Andrews
*Attorney, Agent, or Firm*—Limbach, Limbach & Sutton

[57] ABSTRACT

A process for the exploitation of low-grade oxidic and iron-bearing complex ores or concentrates, whereby the initial materials are reduced in a rotary kiln at a temperature of 1000°-1500° C. in such a manner that the products are a magnetic fraction primarily consisting of iron, and a non-magnetic oxide fraction, the materials present in this fraction being further exploitable by conventional methods.

3 Claims, 2 Drawing Sheets

PROCESS FOR EXPLOITATION OF LOW GRADE OXIDIC AND IRON-BEARING COMPLEX ORES OR CONCENTRATES

This is a continuation of application Ser. No. 679,262, filed Dec. 7, 1984, now abandoned which is a continuation of application Ser. No. 339,807 filed Jan. 15, 1982 now abandoned.

BACKGROUND OF THE INVENTION

1. Field of the Invention

The present invention relates to a process for the exploitation of low-grade oxidic and iron-bearing complex ores or concentrates. The invention relates in particular to a process according to which iron-bearing, oxidic complex ores of chromium, aluminum, vanadium, titanium, nickel, manganese and cobalt are exploited.

2. Description of the Prior Art

A corresponding simultaneous exploitation process is not known in the current state of the art, but initial materials which contain several substances to be recovered are treated by several different methods.

Chromium chemicals are usually produced by an oxidizing calcination of a chromite mixture of sodium carbonate/calcium carbonate, whereby sodium chromate is obtained as an intermediate product. However, the use of this process involves several quite serious risks in terms of the environment, health and economy. Such harmful factors include the quality requirements for chromite ($SiO_2$ concentration must be lower than 1%), the large amounts of gas present during the calcination, the reaction temperature being 1100° C., and a long reaction time, 4 h, as well as a residue which constitutes a problem. Even after a leach, the residue contains chromate of sodium and calcium, which is gradually dissolved by rainwater, unless it is reduced separately.

From vanadium-bearing ilmenite ores, $(Fe, V)TiO_3$, the vanadium is removed by an oxidizing treatment in the presence of alkali metals. In this case, however, the required amount of alkali is large owing to the alkali-titanium compounds which are formed. In addition, a ferric iron/titanium compound is left as a byproduct; this compound is of little economic value and, owing to its high titanium dioxide content, it is unusable for, for example, the production of raw iron.

The production of ferrochromium from a chromite concentrate or ore is usually carried out in an electric-arc furnace, in which high temperatures have to be used in order to achieve a sufficient reduction rate. In this case it is also necessary to add suitable additives for controlling the melting point and viscosity of the slag, and thus a large amount of feed mixture must be smelted at a high temperature. The amount of electric energy per one tonne of ferrochromium is high, since the required temperatures are 1550°-1600° C. for the metal and 1650°-1700° C. for the slag. Furthermore, the slag thereby obtained is usually waste material or suitable only for purposes of little value, since because of fluxing the melting point of the slag is lowered and thereby the refractory quality of the bricks or mixes possibly made from the slag is lowered. The process has a further disadvantage in that the coke used as a reductant must be of a high quality. High-quality coke is difficult to obtain, and furthermore, its price is high.

The treatment of an aluminum oxide-bearing laterite in order to form pure alumina, $Al_2O_3$, is carried out using the Bayer or the Pedersen process. The disadvantage of the Bayer process is that laterite in which the proportion of hematite is high and the proportion of aluminum oxide respectively low cannot be used in the process. In addition, an iron-bearing red mud is produced in the Bayer process, and this red mud is difficult and expensive to dispose of. The disadvantage of the Pedersen process is that the consumption of energy in the electric-furnace smelting of the process is high, since the lime has to be fed in as limestone, or it has to be calcinated separately before the smelting.

SUMMARY OF THE INVENTION

The object of the present invention is to eliminate the disavantages of the current state of the art and to provide a recovery process which is economical in terms of both energy technology and the materials used and which, furthermore, converts all the material used to a usable form.

In the process according to the invention, the raw material or mixture of raw materials, the coke used as reductant, and the additives for the control of the composition are fed into a rotary kiln. A suitable gas atmosphere, a suitable temperature profile and a suitable retention period are set up for the rotary kiln in order to obtain the desired product. The temperature profile is achieved by burning the fuel in a controlled manner in the reaction zones. The fuel used for heating the rotary kiln is oil, gas, coal dust, or the like, depending on the local situation.

The temperature range of the process according to the invention is 1100°-1500° C., preferably 1250°-1400° C., in the reaction zone of the rotary kiln, even though materials with highly different initial compositions can be treated in the rotary kiln. The correct temperature profile for each material is obtained by controlling the mixture of combustion air and fuel gas.

The product of the process according to the invention is cooled in a controlled manner in order to prevent oxidation or by following a suitable cooling curve in order to obtain the desired final product phases. The cooling is carried out in a cooling drum. The obtained product is comminuted when necessary, and the metal or metal alloy is separated from the slag by a magnetic method, by a method based on the difference in the specific gravities, or by a wet-chemical method.

BRIEF DESCRIPTION OF THE DRAWINGS

In order to illustrate the invention, reference is made to the accompanying drawings, in which.

DESCRIPTION OF THE PREFERRED EMBODIMENTS

Figure 2:
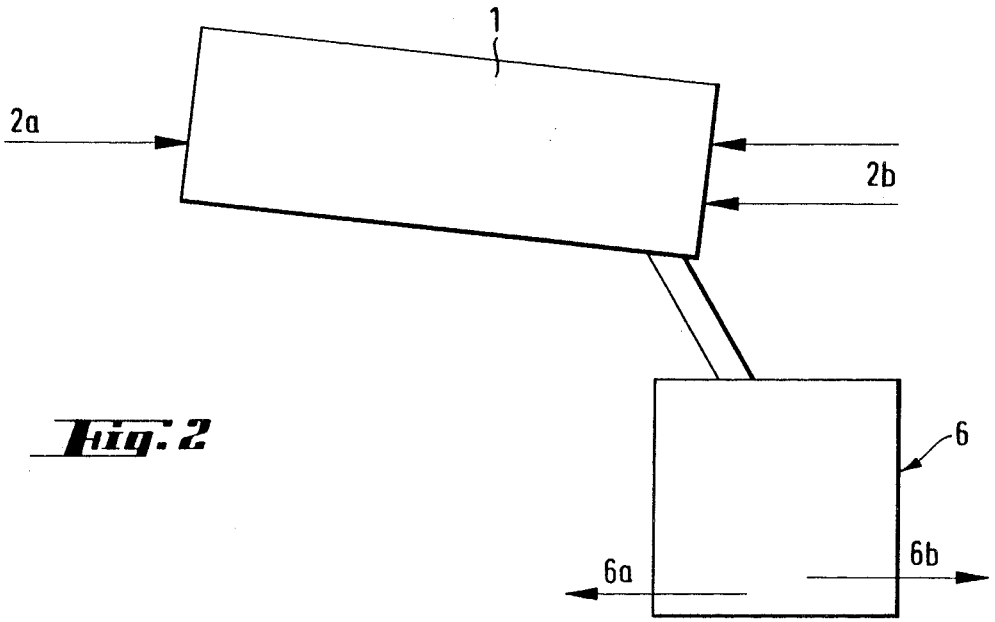
FIG. 2 depicts an embodiment of the same process, using a two-stage rotary kiln/electric furnace treatment.

In the figures, the rotary kiln is indicated by reference numeral 1. The solid material 2*a* and the combustion air and the reduction gas 2*b* are fed into the furnace. The reaction gases can be used for the drying or preheating of the feed material. In FIG. 2, the electric furnace is indicated by 6. Subsequent to emerging from the furnace, the product is cooled in a cooling drum 3, from where the product passes into a grinding apparatus 4 and further to magnetic separation 5.

Table 1 below depicts, by way of example, the compositions of the initial materials 2a to be exploited and the fractions which constitute the final products, 5a, 5b, 6a and 6b.

TABLE 1

Figure 1:
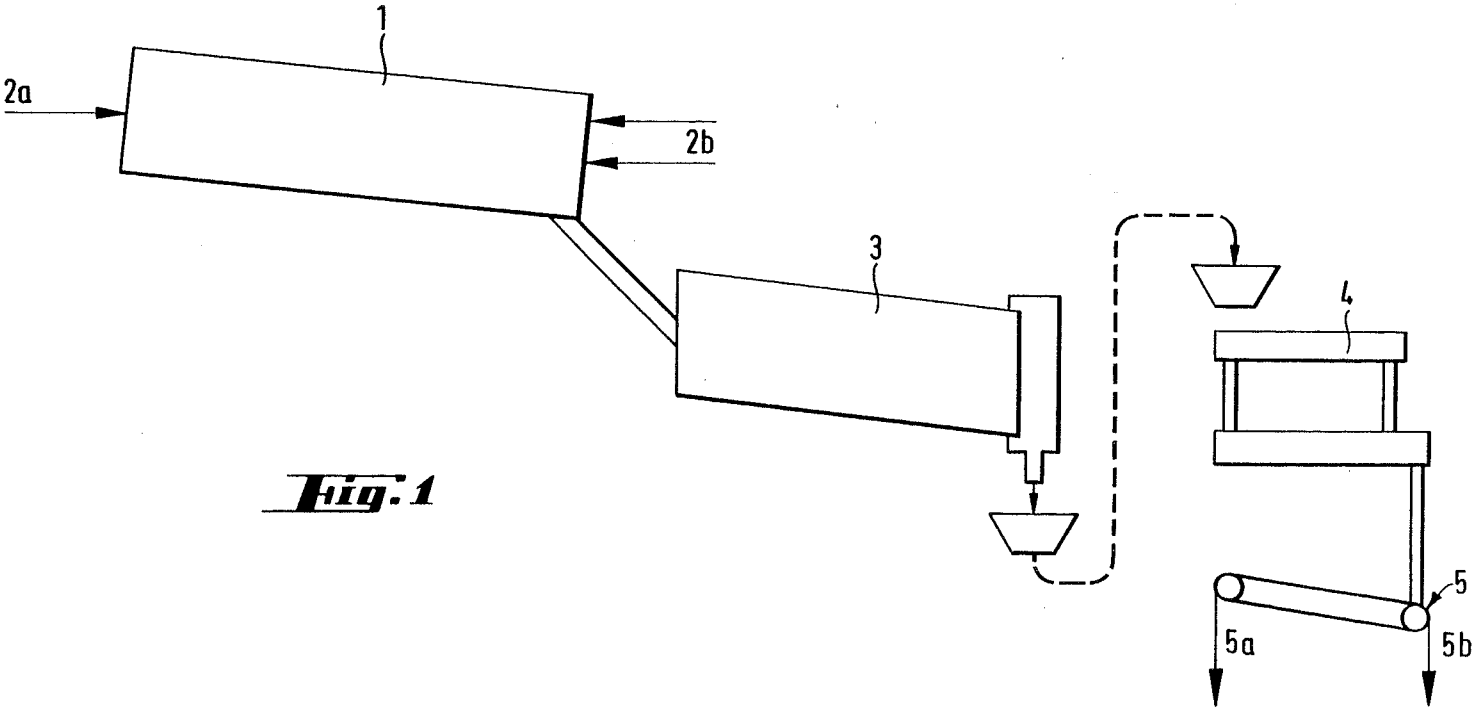
FIG. 1 depicts diagrammatically the flow of the recovery process according to the invention.

| | Fractions of FIG. 1: | |
|---|---|---|
| 2a | 5a | 5b |
| 1. Chromite | 1. FeCr granule | 1. Raw material for Mg—Al silicate mix |
| 2. Chromite $Na_2CO_3$ | 2. Fe granule | 2. Na chromite → Cr salts |
| 3. Chromite, Ni laterite | 3. CrNiFe granule | 3. Simultaneously calcined Cr magnesite, forsterite |
| 4. Cu—Co-bearing Ni laterite | 4. Furnace residue | 4. Raw material for slagwool |
| 5. V, Ti laterite, V-bearing ilmenite | 5. Fe granule | 5. $CaV_2O_3$, $TiO_2$, FeTi raw material |
| 6. Al laterite | 6. Fe granule | 6. $Al_2O_3$ raw material |
| | Fractions of FIG. 2: | |
| 2a | 6a | 6b |
| 1. Chromite laterite, $MgCO_3$ | 1. FeCr | 1. Raw material for Mg—Al silicate mix |
| 2. Chromite, Ni | 2. Cr, Ni pre-alloy | 2. Simultaneously calcined Cr magnesite, forsterite |
| 3. Ni laterite | 3. FeNi | 3. Raw material for rockwool |
| 4. V-bearing ilmenite | 4. $CaV_2O_5$, raw iron | 4. $TiO_2$, FeTi raw material |
| 5. Mn ore | 5. FeMn | 5. Mn slag |
| 6. Al laterite | 6. Raw iron | 6. $Al_2O_3$ raw material |

By the process according to the invention it is possible to produce chromium chemicals (Example 1) from a chromite-based initial material without the formation of harmful alkali and/or earth-alkali chromate, since according to the invention the alkalis used form either oxides or silicates. In addition, the treatment period is substantially shorter, and the gas amounts used are substantially smaller than in the process according to the current state of the art. Furthermore, since the alkalis used form silicates in the process according to the invention, the obtaining of a $SiO_2$ concentration sufficiently low considering the quality requirements of chromium chemicals does not cause problems in the further treatment of the product. Thus the quality requirements of chromium chemicals can be fulfilled advantageously.

When a vanadium-bearing ilmenite is treated by the process according to the invention (Example 2), all the metal constituents, vanadium and iron and titanium, are obtained in an exploitable form. Titanium passes as titanium dioxide into the non-magnetic fraction of the rotary kiln product, and it can be used for the production of metallic titanium. Vanadium, for its part, passes together with iron into the magnetic fraction. When the magnetic fraction is treated further, the vanadium can be recovered as calcium vanadate ($CaC_2O_5$) from the slag which comes from the refining of raw iron. The calcium vanadate can be used, by methods known per se, for the production of vanadium pentoxide or as raw material for ferrovanadium.

By the process according to the invention, an aluminum oxide-bearing laterite (Example 3) can, without a separate agglomeration of the feed material, be converted to soluble salts. In this case the laterite passes into the slag of the rotary kiln process, and a magnetic separation is carried out on this slag after cooling. In the non-magnetic fraction the aluminum oxide-bearing laterite forms phases soluble in an alkaline solution, and the final product, aluminum oxide, can be recovered from these phases by a method known per se. Thus it is necessary to carry out only a magnetic separation before the process for the recovery of aluminum oxide. The magnetic fraction, for its part, contains only raw iron. The non-magnetic fraction as such can also be used as raw material for, for example, aluminate cement.

By the process according to the invention it is also possible to produce a pre-alloy for, for example, the noble steel industry or ferrochromium production (Examples 4, 5). In this case, for example, the particle size of the product and the ratios of the various constituents of the alloy (Cr/Ni ratio in stainless steel) are adjusted in the rotary kiln so as to be advantageous for the process stages which follow. If a mangetic separation is carried out on the rotary kiln product, the non-magnetic fraction can be used for the production of ferrochromium and/or as raw material for chromite or chromium magnesite bricks, and the magnetic fraction can be used for the production of noble steel.

EXAMPLES

Example 1

In order to produce chromium chemicals by the process according to the invention, chromite (particle size 90% −200 mesh, analysis 28.5% Fe, 25.2% Cr, 7.9% Al, 0.7% V, 0.8% Mn+Ni) was fed into a rotary kiln together with carbon and an alkali salt. Carbon was used in an excess of 10% by weight of the amount necessary for the reduction of the iron, nickel and magnanese. The alkali salt contained sodium carbonate and sodium sulfate at a ratio of 4:1, and its amount corresponded to the compounds $Na(Cr, Al, V)O_2$ and $Na_2Al_2Si_6O_{16}$. The reaction time in the rotary kiln was 15 min and the reaction temperature was 1100° C. The yield of iron into the magnetic fraction was 95%, and the concentration of iron in the magnetic fraction was 90% by weight, and thus the magnetic fraction was as such suitable for further refining of iron. The chromium, which remained unreduced, passed almost completely into the non-magnetic oxidic fraction, since the concentration of chromium in the magnetic fraction was only 0.7% by weight. The non-magnetic oxide fraction can be developed further for the further refining of chromium chemicals and/or chromium, and the accompanying vanadium can be prepared for the production of vanadium pentoxide by methods known per se.

Example 2

An iron-rich, vanadium-bearing ilmenite (54.6% $Fe_2O_3$, 41% $TiO_2$, 0.65% V) was fed into a rotary kiln together with carbon and a ($FeS_2$+CaO) mixture in order to recover the metal constituents by the process according to the invention. The amount of the ($FeS_2$+CaO) mixture was 14% of the ilmenite amount, and the amount of carbon was 3% by weight more than was necessary for the reduction of the oxidic iron to metallic iron. The reaction period of the material in the rotary kiln was 2 h at a temperature of 1400° C. The concentration of titanium oxide obtained in the non-magnetic fraction varied between the different particles within a range of 85–95% by weight, and thus it could be used for the production of metallic titanium. The yield of vanadium into the magnetic fraction was 90%, and its concentration was 4–11% by weight. When the magnetic fraction was treated further to produce raw iron, the vanadium passed into the slag phase, since owing to the forming calcium vanadate, $CaV_2O_5$, the activity ratio between the slag phase and the metal phase changed.

Example 3

Laterite ore 100.0 parts by weight, quartz 2.4 parts by weight, coke 11.7 parts by weight, and limestone 62.0 parts by weight were fed into a rotary kiln in order to produce alumina by the process according to the invention.

The compositions of the feed materials were as follows:

| Laterite % by weight | | Coke % by weight | | Limestone % by weight | | Quartz % by weight | |
|---|---|---|---|---|---|---|---|
| $Al_2O_3$ | 38.3 | $C_{fix}$ | 87.3 | $CaCO_3$ | 98.2 | $SiO_2$ | 96.5 |
| $Fe_{tot}$ | 25.4 | Ashes | 10.2 | MgO | 0.72 | Others | 1.1 |
| $Fe^{2+}$ | 0.2 | S | 0.64 | $SiO_2$ | 0.06 | | |
| $SiO_2$ | 1.0 | P | 0.029 | Others | 1.0 | | |
| MgO | 0.04 | $SiO_2$ | 5.63 | | | | |
| CaO | 0.01 | $Al_2O_3$ | 2.52 | | | | |
| $TiO_2$ | 3.7 | MgO | 0.20 | | | | |
| Calcination loss | 22.8 | CaO | 0.55 | | | | |
| | | Fe | 0.58 | | | | |
| | | Volatiles | 1.9 | | | | |

The reaction temperature in the rotary kiln was 1200°–1350° C., and the reaction period was 2 h. The rotary kiln product was cooled slowly to 600° C. in a cooling drum, whereafter it was allowed to cool freely. When the rotary kiln product cooled, in the product there formed phases soluble in an alkaline solution, $CaO.Al_2O_3$ and $12CaO.7Al_2O_3$ at a ratio of 2:1, and $2CaO.SiO_2$; owing to the change in the crystal form of the last-mentioned phase, the product broke down into a finely-divided powder. After a magnetic separation was carried out on the product, the compositions of the different fractions were as follows:

| Rotary kiln % by weight | | Slag fraction % by weight | | Metallic fraction % by weight | |
|---|---|---|---|---|---|
| $Fe_{tot}$ | 23.7 | FeO | 0.8 | Fe | 96.5 |
| $Fe_{ox}$ | 0.6 | $SiO_2$ | 4.5 | Ti | 0.1 |
| $Fe_{met}$ | 23.1 | $Al_2O_3$ | 46.6 | Si | 0.5 |
| $SiO_2$ | 3.5 | MgO | 0.5 | C | 1.7 |
| $Al_2O_3$ | 35.9 | CaO | 41.7 | Others | 1.2 |
| MgO | 0.4 | $TiO_2$ | 4.4 | | |
| CaO | 32.1 | $C_{fix}$ | 1.2 | | |
| $TiO_2$ | 3.4 | Others | 0.3 | | |
| $C_{fix}$ | 0.9 | | | | |
| Others | 0.2 | | | | |

The non-magnetic fraction was leached further by a method known per se, whereby the total yield of aluminum into the solution was 95%. The rotary kiln products can be used directly as raw material in the steel industry.

Example 4

A pre-alloy for stainless steel was prepared from Ni-laterite and chromite by reducing the concentrate mixture in a rotary kiln by the process according to the invention. The compositions of the feed materials were:

| | Ni laterite % by weight | Chromite % by weight | Coke % by weight |
|---|---|---|---|
| Fe | 11.0 | 17.3 | |
| Ni | 2.8 | 0.09 | |
| Cr | | 27.4 | |
| C | | | 90.0 |
| $SiO_2$ | 30.9 | 7.6 | 6.0 |
| MgO | 23.0 | 12.7 | |
| $Al_2O_3$ | 2.1 | 12.4 | 3.0 |
| CaO | 0.13 | 0.9 | |
| Others | 26.0 | | 1.0 |

In the rotary kiln the reduction was carried out at a temperature of 1300°–1350° C. using a carbon amount which was 20% more than was required for attaining the desired degree of reduction. Of the 100 parts by weight of Ni laterite and 30 parts by weight of chromite fed into the kiln there was obtained 88.2 parts by weight reduced rotary kiln product, the composition of the product being 7.0% Cr, 16.5% Fe, 2.9% Ni, 36.9% $SiO_2$, 28.9% MgO, 6.4% $Al_2O_3$, 0.4% CaO, and 1.1% C. A magnetic separation of the rotaty kiln product yielded 23.3 parts by weight metallic fraction which contained 59.8% Fe, 24.6% Cr, 10.6% Ni, 4.0% C and 1.0% Si and which could be used further as raw material for the noble-steel industry. The non-magnetic fraction remaining after the magnetic separation contained 48.6% $SiO_2$, 39.3% MgO, 8.7% $Al_2O_3$, 0.6% CaO, 1.1% $Cr_2O_3$, 1.4% $Fe_2O_3$ and 0.2% NiO. The non-magnetic fraction can be used as a mix constituent in refractory bricks and mixes (for example, bricks and mixes of the forsterite and/or chromium and magnesium/-chromium type).

Example 5

In order to produce ferrochromium by the process according to the invention, chromite concentrate 100 parts by weight, slagging material 10 parts by weight, and coke 15 parts by weight more than was necessary for achieving a stoichiometric reduction result were fed into a rotary kiln. The analyses of the feed materials were as follows:

| Chromite concentrate % by weight | | Slagging material % by weight | | Coke % by weight | |
|---|---|---|---|---|---|
| $Cr_2O_3$ | 53.8 | $Cr_2O_3$ | 1.5 | $C_{fix}$ | 87.0 |
| FeO | 19.8 | FeO | 7.6 | Ashes | 12.0 |
| $SiO_2$ | 5.5 | $SiO_2$ | 56.6 | Volatiles | 1.0 |
| $Al_2O_3$ | 13.8 | $Al_2O_3$ | 5.5 | | |
| MgO | 7.0 | MgO | 21.4 | | |
| CaO | 0.2 | CaO | 0.8 | | |

The rotary kiln reduction was carried out at a temperature of 1300°-1350° C., the reaction period being 1.5 h. The rotary kiln product was cooled, and a magnetic separation was carried out on the cooled pruduct. The analysis of the magnetic fraction (41.5 parts by weight) and the non-magnetic fraction (37.3 parts by weight) were as follows:

| Magnetic fraction (metal phase) % by weight | | Non-magnetic fraction (slag phase) % by weight | |
|---|---|---|---|
| Cr | 61.4 | $SiO_2$ | 28.2 |
| Fe | 33.0 | MgO | 23.1 |
| C | 4.9 | $Al_2O_3$ | 37.0 |
| Si | 0.05 | CaO | 0.7 |
| | | $Cr_2O_3$ | 3.4 |
| | | FeO | 1.2 |

The magnetic fraction is a finished high-carbon ferrochromium product, whereas the slag phase can be used as a raw material for, for example, a magnesium-aluminum silicate mix.

Even though the specification and examples describe the use of a rotary kiln only, it is self-evident for an expert in the art that some other similar furnace system can also be used for the same purpose.

Example 6

In this example, the aluminum oxide-bearing laterite of Example 3 was treated in such a manner that the raw material was first pretreated in a rotary kiln, whereafter the material was transferred into an electric furnace in order to carry out the reactions to completion in a manner economical in terms of energy, in which case it was not necessary to carry out a magnetic separation on the product obtained from the electric furnace.

An aluminum oxide-bearing laterite ore 100.0 parts by weight, limestone 27.1 parts by weight, quicklime 16.5 parts by weight, and coke 17.0 parts by weight were fed into a rotary kiln. The chemical compositions of the feed materials were as follows:

| Laterite % by weight | | Coke % by weight | | Limestone % by weight | | Quicklime % by weight | |
|---|---|---|---|---|---|---|---|
| $Al_2O_3$ | 31.1 | $C_{fix}$ | 88.1 | CaO | 52.8 | CaO | 91.2 |
| $Fe_{tot}$ | 30.7 | Ashes | 10.8 | $Al_2O_3$ | 0.6 | $Al_2O_3$ | 1.5 |
| $SiO_2$ | 4.7 | S | 1.3 | $SiO_2$ | 1.5 | $SiO_2$ | 5.3 |

-continued

| Laterite % by weight | | Coke % by weight | | Limestone % by weight | | Quicklime % by weight | |
|---|---|---|---|---|---|---|---|
| MgO | 0.1 | P | 0.01 | MgO | 0.9 | MgO | 1.5 |
| CaO | 0.13 | $SiO_2$ | 5.3 | Volatiles | 42.5 | Volatiles | 0.9 |
| $TiO_2$ | 4.4 | $Al_2O_3$ | 2.8 | | | | |
| Volatiles | 20.2 | MgO | 0.2 | | | | |
| | | CaO | 0.4 | | | | |
| | | $Fe_{tot}$ | 0.7 | | | | |
| | | Volatiles | 1.2 | | | | |

The reaction period in the rotary kiln was 2 h, and the reaction temperature was 1200°-1350° C. Thereby, there was obtained at 1110° C. a rotary kiln product of a proportion of 104 parts by weight, its composition being 27.2% $Al_2O_3$, 26.5% CaO, 6.2% $SiO_2$, 27.7% $Fe_{tot}$, 3.8% $TiO_2$, 0.5% MgO, and 4.9% C. The rotary kiln product was cooled to 530° C., whereafter it was fed, together with quicklime, into an electric furnace at a ratio of 56.4 parts by weight kiln product to 1.7 parts by weight quicklime. From the electric furnace there was obtained 16.0 parts by weight raw iron at a temperature of 1420°-1450° C., and 37.4 parts by weight electric furnace slag at a temperature of 1500°-1550° C.

| Raw iron % by weight | | Electric furnace slag % by weight | |
|---|---|---|---|
| $Fe_{met}$ | 92.6 | $Al_2O_3$ | 41.0 |
| Al | 0.2 | CaO | 44.0 |
| Ti | 0.7 | $SiO_2$ | 7.8 |
| Si | 0.8 | FeO | 2.7 |
| C | 4.9 | $TiO_2$ | 3.1 |
| Mn | 0.08 | MgO | 1.0 |
| Others | 0.8 | Others | 0.4 |

The electric furnace slag was cooled in accordance with Example 3, whereafter the product was leached in an alkaline solution.

What is claimed is:

1. A process for the exploitation of a material of low-grade oxidic, iron-bearing complex ores or concentrates, and for the conversion to a usable form of metals, present in the ores or concentrates, selected from the group consisting of chromium, aluminum, vanadium, titanium, nickel, manganese and cobalt, comprising the steps of contacting the material to be exploited at a temperature of 1250°-1400° C. with a slagging agent, in the presence of a reductant, to form a metal phase and a slag phase, said metal phase usable for the exploitation of metals selected from the group consisting of iron, vanadium, nickel and cobalt, said slag phase usable for the exploitation of metals selected from the group consisting of chromium, aluminum, titanium, manganese, vanadium, nickel, and cobalt, and, cooling said metal phase under carefully controlled conditions to prevent oxidation of the reduced metal components of the metal phase.

2. A process according to claim 1 wherein said reductant is coke.

3. A process according to claim 1 wherein said reductant is coal dust.

* * * * *